US011229944B2

(12) United States Patent
Kececi

(10) Patent No.: US 11,229,944 B2
(45) Date of Patent: Jan. 25, 2022

(54) SEPARATOR FOR RIVET ELEMENTS AND RIVET CASSETTE

(71) Applicant: Broetje-Automation GmbH, Rastede (DE)

(72) Inventor: Oktay Kececi, Wilhelmshaven (DE)

(73) Assignee: Broetje-Automation GmbH, Rastede (DE)

( * ) Notice: Subject to any disclaimer, the term of this patent is extended or adjusted under 35 U.S.C. 154(b) by 0 days.

(21) Appl. No.: 16/644,421

(22) PCT Filed: Jun. 14, 2018

(86) PCT No.: PCT/EP2018/065745
§ 371 (c)(1),
(2) Date: Mar. 4, 2020

(87) PCT Pub. No.: WO2019/048097
PCT Pub. Date: Mar. 14, 2019

(65) Prior Publication Data

US 2020/0215601 A1 Jul. 9, 2020

(30) Foreign Application Priority Data

Sep. 5, 2017 (DE) ..... 20 2017 105 359.8

(51) Int. Cl.
*B21J 15/32* (2006.01)
*B21J 15/30* (2006.01)

(52) U.S. Cl.
CPC ..... *B21J 15/32* (2013.01); *B21J 15/30* (2013.01); *B21J 15/323* (2013.01)

(58) Field of Classification Search
CPC ..... B21J 15/32; B21J 15/30; B21J 15/323
See application file for complete search history.

(56) References Cited

U.S. PATENT DOCUMENTS 403,843 A * 5/1889 Junkins ..... G07F 11/16 221/251
2,244,048 A * 6/1941 Butter ..... B21J 15/32 227/149

(Continued)

FOREIGN PATENT DOCUMENTS

DE 69101918 2/1995
EP 0511093 10/1992

(Continued)

OTHER PUBLICATIONS

"German Search Report," for German Patent Application No. 202017105359.8 dated Jun. 26, 2018 (5 pages).

(Continued)

*Primary Examiner* — Ryan J. Walters
(74) *Attorney, Agent, or Firm* — Pauly, DeVries Smith & Deffner LLC

(57) ABSTRACT

A separator for rivet elements, having an entrance and an exit for the rivet elements to be separated and having a guide extending along a center line from the entrance to the exit, through which the rivet elements can be delivered along a delivery direction, wherein the separator comprises a first blocking element, especially a first pin, and a second blocking element spaced apart from the first blocking element along the center line, wherein the first blocking element and the second blocking element are movable independently of each other between a blocking position blocking the guide for a rivet element and a releasing position releasing the guide for a rivet element. It is proposed that at least one blocking element is arranged such that the direction of movement of the blocking element or elements is oriented at a slant to the delivery direction of the rivet elements.

21 Claims, 3 Drawing Sheets

(56) References Cited

U.S. PATENT DOCUMENTS

| | | | | |
|---|---|---|---|---|
| 3,901,515 | A | 8/1975 | Mozel | |
| 5,011,339 | A * | 4/1991 | Aurtoi | B21J 15/32 406/191 |
| 5,465,868 | A * | 11/1995 | Bonomi | B23P 19/001 221/165 |
| 6,592,015 | B1 * | 7/2003 | Gostylla | B25B 23/04 227/112 |
| 8,950,626 | B2 * | 2/2015 | Auriol | B23P 19/005 221/278 |
| 9,724,750 | B2 * | 8/2017 | Gostylla | B21J 15/32 |
| 2012/0117795 | A1 * | 5/2012 | Zou | B21J 15/32 29/812.5 |

FOREIGN PATENT DOCUMENTS

| | | |
|---|---|---|
| EP | 0618022 | 10/1994 |
| FR | 3006923 | 12/2014 |
| SU | 416143 | 6/1974 |
| SU | 481361 | 8/1975 |
| SU | 549228 | 3/1977 |
| SU | 590067 | 1/1978 |
| SU | 1103979 | 7/1984 |
| WO | 2009087333 | 7/2009 |
| WO | 2019048097 | 3/2019 |

OTHER PUBLICATIONS

"International Preliminary Report on Patentability," for PCT Application No. PCT/EP2018/065745 dated Mar. 10, 2020 (11 pages) with English Translation of Written Opinion.

"International Search Report and Written Opinion," for PCT Application No. PCT/EP2018/065745 dated Sep. 20, 2018 (12 pages).

"Search Report," for Russian Patent Application No. 2020111552/05(019510) dated Sep. 13, 2021 (2 pages) English Translation only.

* cited by examiner

SEPARATOR FOR RIVET ELEMENTS AND RIVET CASSETTE

CROSS-REFERENCE TO RELATED APPLICATIONS

This application is a national stage application under 35 U.S.C. 371 of International Patent Application Serial No. PCT/EP2018/065745, entitled "Separator for Rivet Elements," filed Jun. 14, 2018, which claims priority from German Patent Application No. DE 20 2017 105 359.8, filed Sep. 5, 2017, the disclosure of which is incorporated herein by reference.

FIELD OF THE TECHNOLOGY

The disclosure relates to a separator for rivet elements as well as a rivet cassette.

BACKGROUND

Separators for rivet elements are known in various designs in the prior art. Usually they have two blocking elements, which alternately block and release a guide for the guiding of the rivet elements. Thus, for example, a separator from a rivet cassette is known, in which a double pin is moved as the first blocking element for the blocking of the guide between a blocking position and a releasing position. Moreover, this separator comprises a second blocking element, which is likewise formed as a double pin and which is arranged along the delivery direction of the rivet elements offset from the first blocking element. By alternating movement of these two blocking elements to their blocking position and out from the blocking position to their releasing position, the rivet elements can be easily separated. The direction of movement of the blocking elements to the blocking position or to the releasing position is oriented perpendicular to the delivery direction in this case. The drawback to this design of the rivet elements is that they regularly become jammed with the rivet elements to be blocked and thus result in a blockage of the separator and hence a malfunctioning. This needlessly interrupts a manufacturing process, since a riveting machine can no longer be supplied with rivet elements.

SUMMARY

The problem which the disclosure proposes to solve is to improve the reliability of a separator and thus the supplying of a riveting machine with rivet elements.

The above problem is solved in a separator according to the disclosure.

A jamming of rivet element and blocking element is effectively prevented in that at least one blocking element, such as both blocking elements, are arranged such that the direction of movement of the blocking element or elements is oriented at a slant to the delivery direction of the rivet elements. Since the pressing of the rivet element in the delivery direction on the blocking elements is no longer perpendicular here, the risk of jamming is significantly reduced.

In order to further enhance the reliability of the separator, it may be provided that the direction of movement of at least one blocking element, such as both blocking elements, from the blocking position to the releasing position, has a movement component situated opposite the delivery direction.

Most particularly, a blocking or jamming of the rivet element with the blocking element or elements can be avoided if the direction of movement of at least one blocking element, such as both blocking elements, from the blocking position to the releasing position, has an angle between 40° and 50°, such as between 43° and 47°, or being substantially 45.2° to the delivery direction. Further advantageous geometrical relations between the blocking elements and the delivery direction are specified in various embodiments.

The movement of at least one blocking element, such as both blocking elements, from the blocking position to the releasing position can be a translatory movement and/or a hinged movement.

According to some embodiments, the guide is a tunnel, especially a linear tunnel. It can have a round cross section. In some embodiments, the tunnel is formed by a borehole.

In various embodiments, the blocking elements can be activated by a respective actuator. This produces an especially simple design for the control of the separator.

For the coupling of the separator to a transport section, according to some embodiments the separator can include a coupling element for coupling a coupling element of the transport section, especially for a riveting machine, to the exit of the separator.

Further embodiments of the separator, especially the coupling element, are disclosed herein.

Furthermore, the above described problem is solved by a rivet cassette according to the disclosure.

The same benefits are achieved as described above in connection with the separator. The separator may be designed as described.

According to various embodiments, the rivet cassette may have a cassette entrance for easier filling thereof with rivet elements.

According to various embodiments, the rivet store is a tube. This makes possible an especially simple shape for the oriented store of rivet elements. Moreover the rivet cassette comprises a bypass for taking compressed air from the separator past the rivet store to the cassette entrance.

According to various embodiments, the rivet cassette may comprise a lid for opening the rivet cassette in one modification of the disclosure. In this way, the separator can be secured in particular from the inside in the rivet cassette.

Various embodiments provide a separator for rivet elements, having an entrance and an exit for the rivet elements to be separated and having a guide extending along a center line from the entrance to the exit, through which the rivet elements can be delivered along a delivery direction, wherein the separator comprises a first blocking element, especially a first pin, and a second blocking element spaced apart from the first blocking element along the center line, especially a second pin, wherein the first blocking element and the second blocking element are movable independently of each other between a blocking position blocking the guide for a rivet element and a releasing position releasing the guide for a rivet element, wherein at least one blocking element, such as both blocking elements, are arranged such that the direction of movement of the blocking element or elements is oriented at a slant to the delivery direction of the rivet elements.

In various embodiments, the direction of movement of at least one blocking element, such as both blocking elements, from the blocking position to the releasing position, has a movement component situated opposite the delivery direction.

In various embodiments, the direction of movement of at least one blocking element, such as both blocking elements, from the blocking position to the releasing position, has an angle between 40° and 50°, such as between 43° and 47° or being substantially 45.2° to the delivery direction.

In various embodiments, the angle between the direction of movement of at least one blocking element, such as both blocking elements, from the blocking position to the releasing position, corresponds substantially to the bevel angle of a rivet element to be held blocked in the guide.

In various embodiments, direction of movement of the first blocking element from the blocking position to the releasing position comprises an angle between 37° and 47°, such as between 40° and 44°, or being substantially 42°, to the direction of movement of the second blocking element from the blocking position to the releasing position.

In various embodiments, the blocking elements at least in their blocking position protrude into the guide, in particular through openings of the guide, such as at the place where the blocking elements pass through the openings of the guide the distance component of the distance between the center axes of the two blocking elements in the delivery direction F is at most 10 mm, at most 8 mm, at most 6 mm, and/or at the place where the blocking elements pass through the openings of the guide the distance component of the distance between the center axes of the two blocking elements in the delivery direction F is at least 3 mm, or at least 5 mm.

In various embodiments, at the place where the blocking elements pass through the openings of the guide the distance component of the distance between the center axes of the two blocking elements in the delivery direction F is greater than the length of the rivet head of a rivet element to be held blocked in the guide, and/or at the place where the blocking elements pass through the openings of the guide the distance component of the distance between the center axes of the two blocking elements in the delivery direction F is less than the rivet length of a rivet element to be held blocked in the guide.

In various embodiments, the movement of at least one blocking element, such as both blocking elements, from the blocking position to the releasing position is a translatory movement and/or a hinged movement.

In various embodiments, the guide is a tunnel, especially a linear tunnel, such as with a round cross section.

In various embodiments, at least one blocking element, such as both blocking elements, is activated by a respective actuator, especially a pneumatic cylinder, and, in some embodiments, the actuator or the actuators have a reset spring, which pretensions the blocking element or the blocking elements in the blocking position.

In various embodiments, the separator comprises a coupling element for coupling a coupling element of a transport section, especially for a riveting machine, to the exit of the separator.

In various embodiments, the separator, such as the coupling element of the separator, comprises at least one first, one first and one second, or a first, a second, and a third air inlet for compressed air supply, especially that of the separator and/or a rivet cassette containing the separator.

In various embodiments, the first actuator can be supplied with compressed air by means of the first air inlet for the activating of the first blocking element, and/or the second actuator can be supplied with compressed air by means of the second air inlet for the activating of the second blocking element, and/or compressed air can be relayed by means of the third air inlet for the delivery of rivet elements by the separator, especially to a bypass of a rivet cassette containing the separator.

Various embodiments provide a rivet cassette for the storing of rivet elements having a rivet store for the storing of rivet elements and having a rivet element exit, wherein the rivet cassette comprises a separator as described herein, and, in some embodiments, the rivet element exit is formed by a separator as described herein.

In various embodiments, the rivet cassette has a cassette entrance for filling the rivet store with rivet elements, such as the cassette entrance and the rivet element exit are arranged at the same end face of the rivet cassette.

In various embodiments, the rivet store is configured as a tube, especially as a coiled tube pack, such as one end of the tube is connected to the separator and the other end of the tube is connected to the cassette entrance.

In various embodiments, the rivet cassette comprises a bypass for taking compressed air from the separator, especially from the third air inlet of the separator past the rivet store to the cassette entrance, such as the air taken through the bypass serves for delivering the rivet elements from the rivet cassette.

In various embodiments, the rivet cassette comprises a lid for opening the rivet cassette, such as the separator is secured in the rivet cassette from the inside.

BRIEF DESCRIPTION OF THE DRAWINGS

In the following, the disclosure shall be explained more closely with its benefits with the aid of a drawing showing only one exemplary embodiment. The drawing shows FIG. 1 a proposed rivet cassette with a proposed separator, FIG. 2 the proposed separator of FIG. 1 and FIG. 3 schematically, the principle of the separating of rivet elements with the proposed separator.

DETAILED DESCRIPTION

Figure 1:
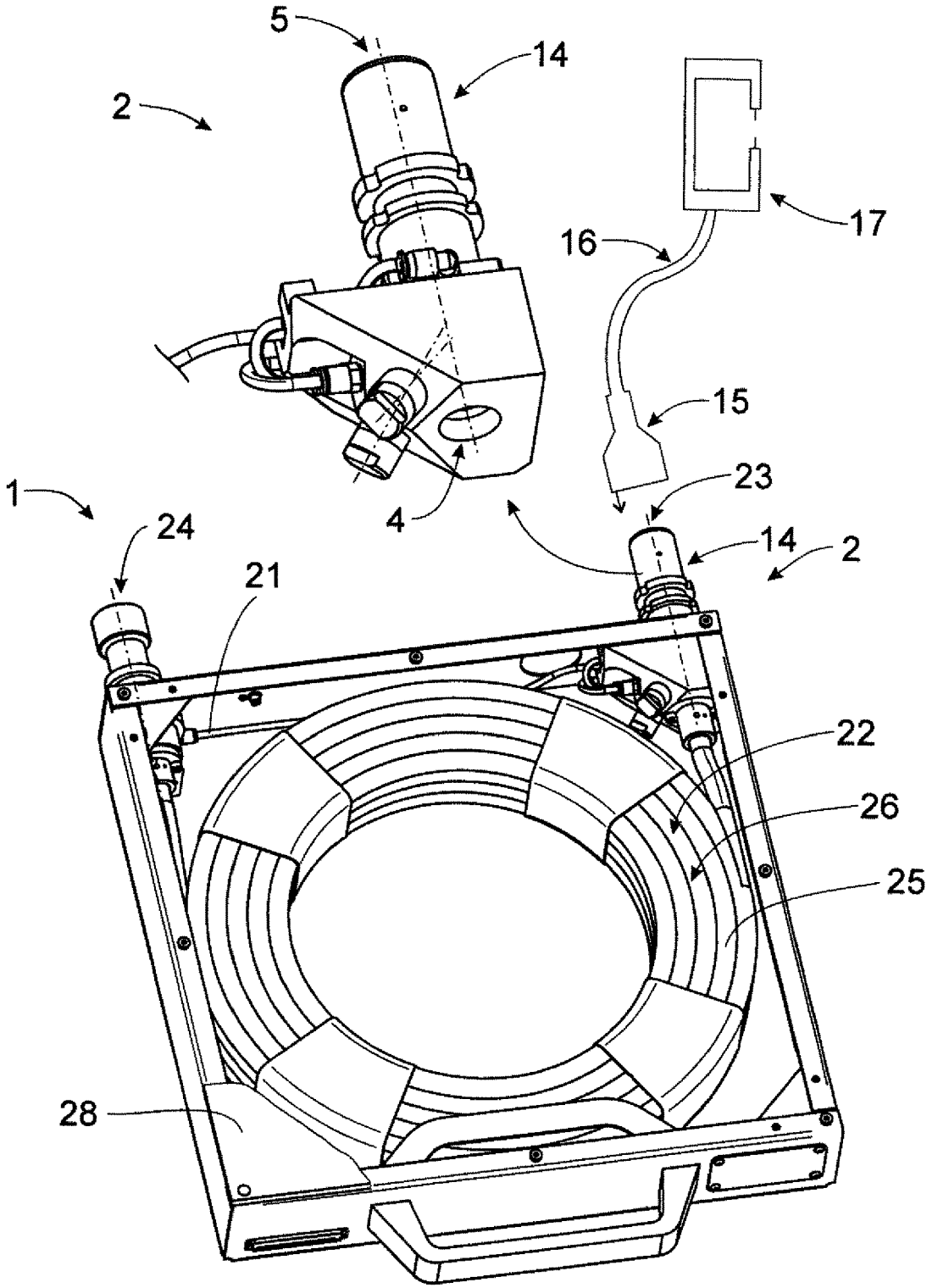

FIG. 1 shows a proposed rivet cassette 1 with a proposed separator 2 for rivet elements 3. The separator 2 has an entrance 4 and an exit 5 for the rivet elements 3 to be separated. Moreover, it has a guide 6 extending along a center line from the entrance 4 to the exit 5. Along the guide 6, the rivet elements 3 can be delivered in a delivery direction F. Here, the guide 6 ensures a directional delivery of the rivet elements 3. This means that the guide 6 makes sure that the rivet elements 3 are always moved with their shaft or their rivet head in front in the delivery direction F, i.e., the rivet head and the shaft cannot change their orientation relative to the delivery direction F. The guide 6 here is fashioned as a borehole 7.

The rivet elements 3 may be rivets, collars, and/or spacers. According to an embodiment, the rivet elements 3 are rivets with a shaft and a rivet head, wherein the rivet head has a greater diameter than the shaft of the rivet.

Moreover, the separator 2 comprises a first blocking element 8 and a second blocking element 9 spaced apart from the first blocking element 8 along the center line M. Here, the first blocking element 8 is formed as a first pin and/or the second blocking element 9 is formed as a second pin. The pins here have a round cross section and/or a rounded head.

The first blocking element 8 and the second blocking element 9 are movable independently of each other between a blocking position blocking the guide 6 for a rivet element 3 and a releasing position releasing the guide for a rivet element 3.

Here, the position in which a rivet element 3 is held by the first blocking element 8 in the separator 2 differs from the position in which the rivet element 3 was held by the second blocking element 9 in the separator 2 with a time delay.

A jamming between a rivet element 3 to be delivered and one of the blocking elements 8, 9 can be effectively prevented in that at least one blocking element 8, 9, such as both blocking elements 8, 9, are arranged such that the direction of movement of the blocking element or elements 8, 9 is oriented at a slant to the delivery direction F of the rivet elements 3. "Oriented at a slant" means here that the direction of movement $B_1$, $B_2$ of the blocking element or elements 8, 9 is oriented at an acute or obtuse angle to the delivery direction F of the rivet elements 3.

Because the delivery direction F of the rivet element 3 is not at right angles to the direction of movement $B_1$, $B_2$ of the blocking element or elements 8, 9, there is no jamming of the rivet element 3 and the blocking element 8, 9, so that the movement of the blocking element 8, 9 is also not blocked in its releasing position.

As shown in FIG. 2*b*, the direction of movement $B_1$, $B_2$ of at least one blocking element 8, 9, here both blocking elements 8, 9, in the movement from the blocking position to the releasing position, has a movement component situated opposite the delivery direction F. This can ensure, in particular, that the blocking element 8, 9 cannot be forced into its releasing position when the delivery air pressure is too high, pressing the rivet element 3 against the blocking element 8, 9. Even so, a secure holding of the rivet elements 3 by the blocking elements 8, 9 is assured.

Figure 2:
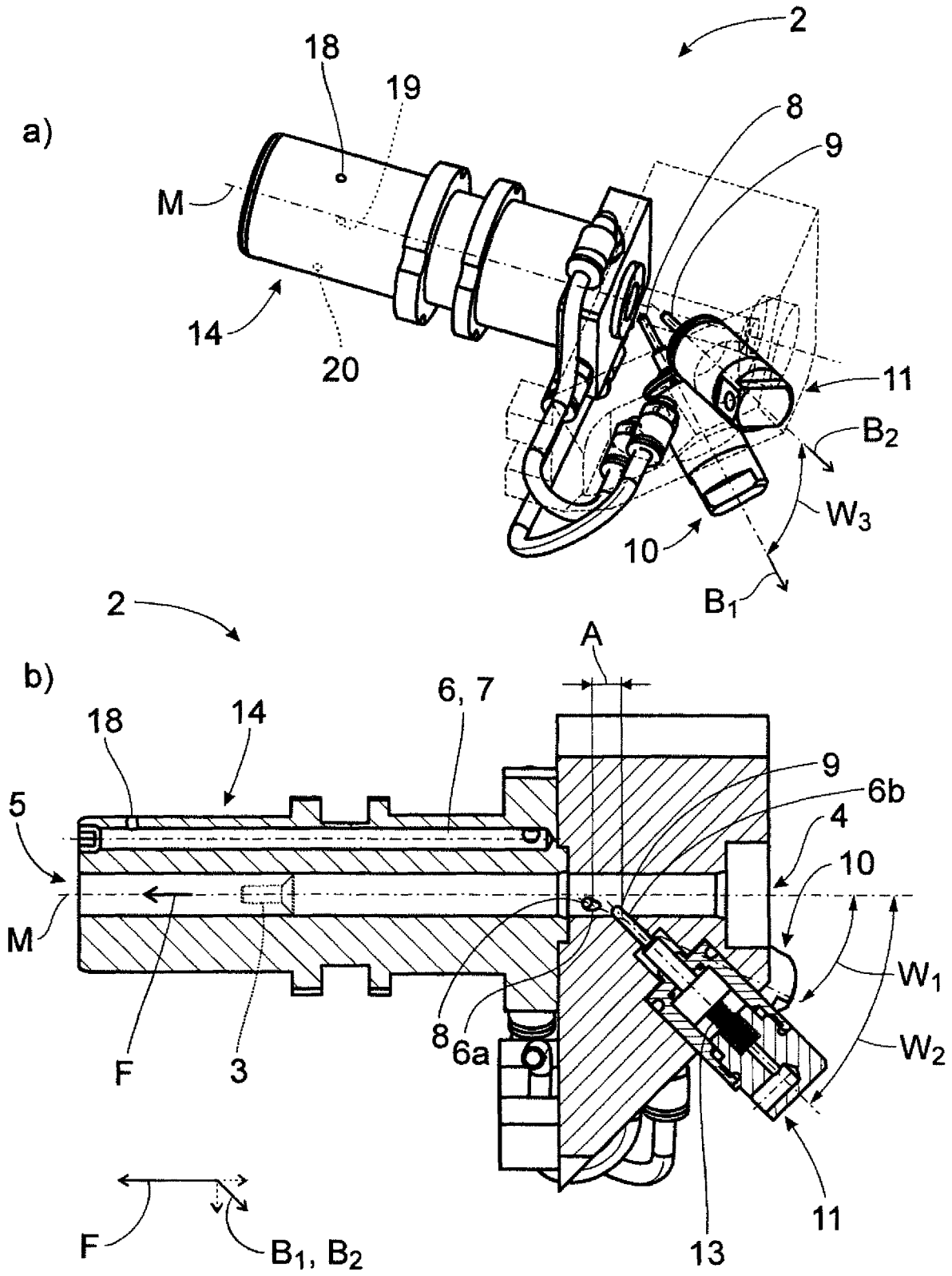

FIG. 2 shows that the direction of movement $B_1$, $B_2$ of at least one blocking element 8, 9, such as both blocking elements 8, 9, from the blocking position to the releasing position, here has an angle $W_1$, $W_2$ between 40° and 50°, such as between 43° and 47°, or being substantially 45.2° to the delivery direction F. It can be that the angle $W_1$ of the direction of movement $B_1$ of the first blocking element 8, 9 from the blocking position to the releasing position in the delivery direction F to correspond substantially to the angle $W_2$ of the direction of movement $B_2$ of the second blocking element 8, 9 from the blocking position to the releasing position in the delivery direction F.

In addition or alternatively, the angle $W_1$, $W_2$ between the direction of movement $B_1$, $B_2$ of at least one blocking element 8, 9, such as both blocking elements 8, 9, from the blocking position to the releasing position, corresponds substantially to the bevel angle $W_F$ of a rivet element 3 to be held blocked in the guide 6. "Substantially" means here a deviation of less than 20%, less than 10%, or less than 5%.

Moreover, the directions of movement $B_1$, $B_2$ of the first and/or second blocking elements 8, 9 may be different. Basically, the directions of movement $B_1$, $B_2$ may be parallel. Here, however, the direction of movement of the first blocking element 8 from the blocking position to the releasing position comprises an angle $W_3$ between 37° and 47°, between 40° and 44°, or being substantially 42°, to the direction of movement of the second blocking element 9 from the blocking position to the releasing position. Here, the directional axes of the directions of movement $B_1$, $B_2$ of the first and/or the second blocking element 8, 9 intersect the center line M of the guide 6. This achieves an especially compact arrangement as well as an especially secure blocking holding of the rivet elements 3 by the blocking elements 8, 9.

In the exemplary embodiment, the blocking elements 8, 9 at least in their blocking position protrude into the guide 6, in particular through openings 6*a*, 6*b* of the guide 6, as shown in FIG. 2.

Figure 3:
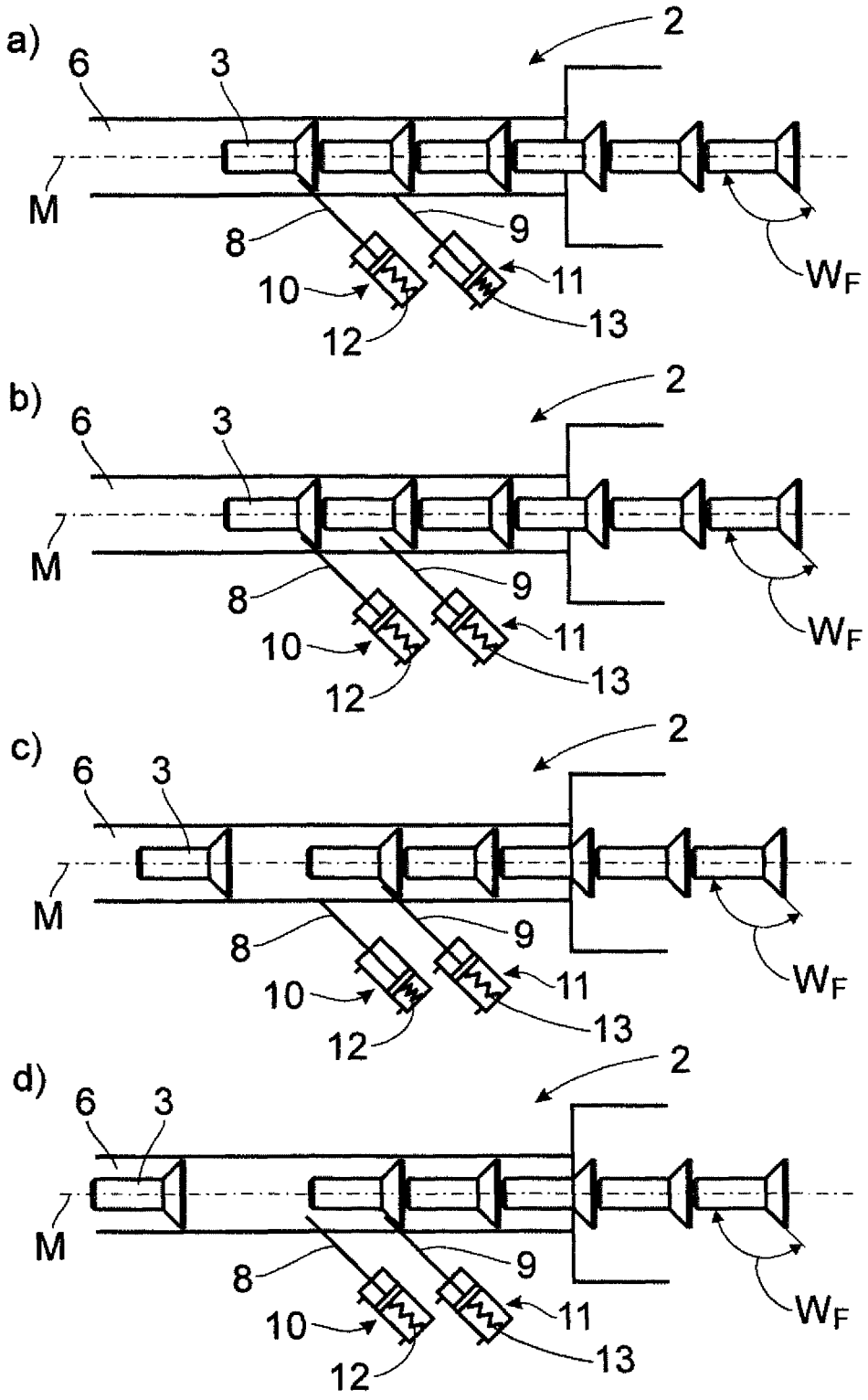

As is likewise shown in FIG. 2*b* and the schematic representation of FIG. 3, here at the place where the blocking elements 8, 9 pass through the openings 6*a*, 6*b* of the guide 6 the distance component A of the distance between the center axes of the two blocking elements 8, 9 in the delivery direction F is at most 10 mm, at most 8 mm, or at most 6 mm, and/or at the place where the blocking elements 8, 9 pass through the openings 6*a*, 6*b* of the guide 6 the distance component A of the distance between the center axes of the two blocking elements 8, 9 in the delivery direction F is at least 3 mm, or at least 5 mm.

As is shown in schematic view in FIG. 3, at the place where the blocking elements 8, 9 pass through the openings 6*a*, 6*b* of the guide 6 the distance component A of the distance between the center axes of the two blocking elements 8, 9 in the delivery direction F is greater than the length of the rivet head of a rivet element 3 to be held blocked in the guide 6, and/or at the place where the blocking elements 8, 9 pass through the openings 6*a*, 6*b* of the guide 6 the distance component A of the distance between the center axes of the two blocking elements 8, 9 in the delivery direction F is less than the rivet length of a rivet element 3 to be held blocked in the guide 6.

If these conditions are met, an especially secure and reliable separation of the rivet elements 3 is ensured. Rivet elements 3 taken up in the separator 2 can be coordinated with the separator 2.

In the exemplary embodiment, the movement of at least one blocking element 8, 9, here both blocking elements 8, 9, from the blocking position to the releasing position is a translatory movement. The movement here is a translatory movement along the longitudinal axis of the blocking elements 8, 9. In addition or alternatively, however, the movement may also be a hinged movement.

As can be seen from FIG. 2, the guide 6 may be a tunnel, especially a linear tunnel. Here, it has a round cross section. In the exemplary embodiment, it is made as a borehole 7. The guide 6 here extends along the longitudinal extension of the separator 2.

In the exemplary embodiment, the separator 2 moreover comprises actuators 10, 11. Here, the first blocking element 8 is activated by an actuator 10 and/or the second blocking element 9 can be activated by a second actuator 11. In the exemplary embodiment, the actuators 10, 11 are pneumatic cylinders. The actuators 10, 11 here each have a reset spring 12, 13, which pretensions the blocking elements 8, 9 in the blocking position.

The pretensioning in the blocking position can reliably prevent any rivet elements 3 from leaving the separator 2 unintentionally when the separator 2 is not supplied with compressed air. This is especially important for rivet cassettes 1 in particular, since these are usually not supplied with compressed air during their transport.

Moreover, here the separator 2 comprises a coupling element 14 for coupling a coupling element 15 of a transport section 16, especially for a riveting machine 17, to the exit of the separator 2. The separator 2, such as the coupling element 14 of the separator 2, here comprises a first air inlet 18, a second air inlet 19, and a third air inlet 20 for the compressed air supply, especially that of the separator 2 and/or a rivet cassette 1 containing the separator 2. Alternatively, only a first air inlet 18 or only a first air inlet 18 and a second air inlet 19 may be provided.

The air inlets 18, 19, 20 can be distributed about the circumference of the coupling element 14 of the separator 2, such as uniformly distributed. Here, the coupling element 15 of the transport section 16 can have air outlets, corresponding to the air inlets 18, 19, 20, for the supplying of the separator 2 or the rivet cassette 3 with compressed air.

In the exemplary embodiment, the first actuator 10 is supplied with compressed air by means of the first air inlet 18 for the activating of the first blocking element 8. In addition or alternatively, the second actuator 11 can be supplied with compressed air by means of the second air inlet 19 for the activating of the second blocking element 9. In addition or alternatively, compressed air can be relayed by means of the third air inlet 20 for the delivery of rivet elements 3 by the separator 2. The compressed air here is relayed by means of the third air inlet 20 to a bypass 21 of a rivet cassette 1 comprising the separator 2.

The rivet cassette 1 comprising the separator 2 is shown in FIG. 1 and here comprises a rivet store 22. In addition or alternatively, the rivet cassette 3 may comprise a rivet element exit 23 for dispensing rivet elements 3 from the rivet store 22. In the exemplary embodiment, the rivet element exit 23 is formed by the separator 2. In addition, a cassette entrance 24 can be provided for filling the rivet store 22 with rivet elements 3. The cassette entrance 24 can be located at the same end face of the rivet cassette 1 as the rivet element exit 23.

The rivet store 22 here comprises a tube 25. The tube 25 here is coiled as a tube pack 26, as is shown in FIG. 1. It enables a directional storing and delivery of the rivet elements 3. A rotating and thus exchanging of the orientation of the rivet head and the shaft of a rivet element 3 relative to the delivery direction 6 is not possible. The ends of the tube 25 are connected to the entrance 4 and the exit 5 of the rivet cassette 1.

Moreover, the rivet cassette 1 comprises a bypass 21 for taking compressed air from the separator 2, especially from the third air inlet 20 of the separator 2, past the rivet store 22 to the cassette entrance 24. The compressed air taken through the bypass 21 serves for delivering the rivet elements 3 from the rivet cassette 1.

In the exemplary embodiment, the rivet cassette 1 moreover comprises a housing 27 to protect the separator and/or the rivet store 22. Moreover, the rivet cassette 1 can have a lid 28 for opening the rivet cassette 1, in order to install and/or replace the separator 2 and/or the rivet store 22. When replacing the separator 2, here the separator 2 is loosened in the rivet cassette 1 from the inside and fastened to the rivet cassette 1 from the inside.

The separating of the rivet elements 3 occurs here as shown in FIG. 3. In the exemplary embodiment and in the schematic representation of FIG. 3, the respective blocking element 8, 9 to be held engages with the rivet head of the rivet element 3 to be held when the guide for a rivet element 3 is blocked. The respective blocking element 8, 9 thus engages here not with the shaft of the rivet element 3 to be held, but with its rivet head for the holding process.

FIG. 3*a*) shows a starting situation. Here, the first blocking element 8 is located in a blocking position and the second blocking element 9 is located in a releasing position. In this position, here the first blocking element 8 engages with a rivet element 3, while the second blocking element 9 is not engaged with a rivet element 3. The rivet element 3 engaging with the first blocking element 8 is the first rivet element 3 held at the exit side.

For the releasing of this rivet element 3, here the second blocking element 9 is moved likewise into a blocking position, see FIG. 3*b*). In this position as well, here the first blocking element 8 is engaged with the first rivet element 3 at the exit side, while the second blocking element 9 is still not yet engaged with a further rivet element 3.

Now, for the releasing of the first rivet element 3 at the exit side, the first blocking element 8 is moved into a releasing position. The first rivet element 3 at the exit side is now released from the separator 2 by means of the compressed air for the delivery of the rivet elements 3 and taken to the transport section 16. The further rivet elements 3 also slide down in the rivet store by virtue of the compressed air for delivery of the rivet elements 3, until the next rivet element 3 at the exit side reaches the second blocking element 9, being securely held by it. This is shown in FIG. 3*c*).

After this, the first blocking element 8 is moved from the releasing position back to the blocking position, see FIG. 3*d*).

If the second blocking element 9 is then moved to a releasing position, the remaining rivet elements 3 can be delivered to the first blocking element 8, as shown in FIG. 3*a*). This shows schematically the separating of a rivet element 3 with the separator 2. The same situation is produced as was described above for FIG. 3*a*). The process is repeated with each additional rivet element 3 to be separated.

In conclusion, it is pointed out that the first blocking element 8 and the second blocking element 9 in the schematic representation of FIG. 3 are shown for simplicity in a common plane. In various embodiments, however, the directions of movement of the blocking elements 8, 9 are radially offset by an angle from each other, as in connection with FIGS. 1 and 2.

The invention claimed is:

1. A rivet cassette for the storing of rivet elements comprising:

a rivet store configured to store rivet elements, a rivet element exit, and a separator for rivet elements, wherein the separator comprises:

an entrance and an exit for the rivet elements to be separated and a guide extending along a center line from the entrance to the exit, through which the rivet elements can be delivered along a delivery direction, wherein the separator comprises a first blocking element and a second blocking element spaced apart from the first blocking element along the center line, wherein the first blocking element and the second blocking element are movable independently of each other between a blocking position blocking the guide for a rivet element and a releasing position releasing the guide for a rivet element, wherein at least one blocking element of the first blocking element and the second blocking element is arranged such that the direction of movement of the at least one blocking element is oriented at a slant to the delivery direction of the rivet elements.

2. The rivet cassette as claimed in claim 1, wherein the at least one blocking element of the first blocking element and the second blocking element is configured such that wherein the direction of movement of the at least one blocking element of the first blocking element and the second blocking element, from the blocking position to the releasing position, is at least partially opposed to the delivery direction.

3. The rivet cassette as claimed in claim 1, wherein the direction of movement of the at least one blocking element of the first blocking element and the second blocking element from the blocking position to the releasing position, has an angle between 40° and 50° to the delivery direction.

4. The rivet cassette as claimed in claim 3, wherein the angle between the direction of movement of the at least one blocking element of the first blocking element and the second blocking element from the blocking position to the releasing position, corresponds to the bevel angle of a rivet element to be held blocked in the guide.

5. The rivet cassette as claimed in claim 1, wherein the direction of movement of the first blocking element from the blocking position to the releasing position comprises an angle between 37° and 47° to the direction of movement of the second blocking element from the blocking position to the releasing position.

6. The rivet cassette as claimed in claim 1, wherein the blocking elements at least in their blocking position protrude into the guide through openings of the guide, at the place where the blocking elements pass through the openings of the guide, a distance between the center axes of the two blocking elements in the delivery direction is at most 10 mm, and/or at the place where the blocking elements pass through the openings of the guide, a distance between the center axes of the two blocking elements in the delivery direction F is at least 3 mm.

7. The rivet cassette as claimed in claim 6, wherein at the place where the blocking elements pass through the openings of the guide the distance component of the distance between the center axes of the two blocking elements in the delivery direction F is greater than the length of the rivet head of a rivet element to be held blocked in the guide, and/or at the place where the blocking elements pass through the openings of the guide the distance component of the distance between the center axes of the two blocking elements in the delivery direction F is less than the rivet length of a rivet element to be held blocked in the guide.

8. The rivet cassette as claimed in claim 1, wherein the movement of the at least one blocking element of the first blocking element and the second blocking element from the blocking position to the releasing position is a translatory movement and/or a hinged movement.

9. The rivet cassette as claimed in claim 1, wherein the guide is a linear tunnel with a round cross section.

10. The rivet cassette as claimed in claim 1, wherein the at least one blocking element of the first blocking element and the second blocking element is activated by a respective actuator, and the actuator has a reset spring, which pretensions the blocking element or the blocking elements in the blocking position.

11. The rivet cassette as claimed in claim 10, wherein the actuator comprises a pneumatic cylinder.

12. The rivet cassette as claimed in claim 10, wherein the separator comprises a coupling element for coupling a coupling element of a transport section to the exit of the separator.

13. The rivet cassette as claimed in claim 12, wherein the coupling element of the separator comprises a first, a second, and a third air inlet for compressed air supply.

14. The rivet cassette as claimed in claim 13, wherein the actuator can be supplied with compressed air by the first air inlet for the activating of the first blocking element, and/or a second actuator is configured to be supplied with compressed air by the second air inlet for the activating of the second blocking element, and/or compressed air can be relayed by the third air inlet for the delivery of rivet elements by the separator to a bypass of the rivet cassette containing the separator.

15. The rivet cassette as claimed in claim 1, wherein the rivet element exit is formed by the separator.

16. The rivet cassette as claimed in claim 1, wherein the rivet cassette has a cassette entrance for filling the rivet store with rivet elements, wherein the cassette entrance and the rivet element exit are arranged at the same end face of the rivet cassette.

17. The rivet cassette as claimed in claim 1, wherein the rivet store is configured as a coiled tube pack, wherein one end of a tube is connected to the separator and the other end of the tube is connected to a cassette entrance.

18. The rivet cassette as claimed in claim 1, wherein the rivet cassette comprises a bypass for taking compressed air from the separator, wherein the air taken through the bypass serves for delivering the rivet elements from the rivet cassette.

19. The rivet cassette as claimed in claim 1, wherein the rivet cassette comprises a lid for opening the rivet cassette, wherein the separator is secured in the rivet cassette from the inside.

20. The rivet cassette as claimed in claim 1, wherein the first blocking element comprises a first pin and the second blocking element comprises a second pin.

21. A rivet cassette for storing of rivet elements comprising:

a rivet store configured to store rivet elements;

a rivet element exit and a separator for rivet elements, wherein the separator comprises:

an entrance and an exit for the rivet elements to be separated and having a guide extending along a center line from the entrance to the exit, through which the rivet elements can be delivered along a delivery direction, wherein the separator comprises a first blocking element, and a second blocking element spaced apart from the first blocking element along the center line, wherein the first blocking element and the second blocking element are movable independently of each other between a blocking position blocking the guide for a rivet element and a releasing position releasing the guide for a rivet element, wherein both blocking elements are arranged such that the direction of movement of the blocking elements is oriented at a slant to the delivery direction of the rivet elements.

* * * * *